United States Patent [19]

Hinz

[11] 4,200,179

[45] Apr. 29, 1980

[54] APPARATUS FOR CHANGING THE DISTANCE BETWEEN PAIRS OF COAXIAL CIGARETTES OR THE LIKE

[75] Inventor: Werner Hinz, Hamburg, Fed. Rep. of Germany

[73] Assignee: Hauni-Werke Körber & Co. KG., Hamburg, Fed. Rep. of Germany

[21] Appl. No.: 856,571

[22] Filed: Dec. 1, 1977

[30] Foreign Application Priority Data

Dec. 9, 1976 [DE] Fed. Rep. of Germany ..... 2655790

[51] Int. Cl.[2] ..... B65G 47/26

[52] U.S. Cl. ..... 198/458

[58] Field of Search ..... 198/441, 450, 458, 480; 131/94, 20 R; 93/1 C

[56] References Cited

U.S. PATENT DOCUMENTS

| | | | |
|---|---|---|---|
| 3,199,418 | 8/1965 | Schubert | 198/458 X |
| 3,372,702 | 3/1968 | Bohn et al. | 198/458 X |
| 3,446,161 | 5/1969 | Oddy | 198/458 X |
| 3,580,442 | 5/1971 | Rohdin et al. | 198/458 X |
| 3,602,357 | 8/1971 | Schubert | 198/441 X |
| 3,685,633 | 8/1972 | Rudszinat et al. | 198/480 X |
| 3,812,951 | 5/1974 | Fullaway | 198/458 |
| 3,990,572 | 11/1976 | Fishback | 198/458 |

*Primary Examiner*—James L. Rowland
*Attorney, Agent, or Firm*—Kane, Dalsimer, Kane

[57] ABSTRACT

Apparatus for increasing the distance between pairs of coaxial plain cigarettes has a rotary drum-shaped conveyor with a rotor which carries two annuli of axially movable segment-shaped holders provided with peripheral flutes for plain cigarettes. A cam with two endless grooves cooperates with rollers followers which are affixed to shifting rods for the holders to move successive aligned holders nearer to each other during travel toward a first transfer station where the flutes receive plain cigarettes and to thereupon move the holders apart during travel toward a second transfer station where the cigarettes are transferred into the flutes of a rotary assembly conveyor and are spaced apart to an extent which suffices for insertion of filter mouthpieces of double unit length. The holders are guided by tie rods which are reciprocable in a collar of the rotor.

15 Claims, 3 Drawing Figures

APPARATUS FOR CHANGING THE DISTANCE BETWEEN PAIRS OF COAXIAL CIGARETTES OR THE LIKE

BACKGROUND OF THE INVENTION

The present invention relates to apparatus for manipulating rod-shaped articles which constitute or form part of smokers' products. More particularly, the invention relates to improvements in apparatus for changing the distance between pairs of coaxial rod-shaped articles, such as plain cigarettes.

In the manufacture of filter cigarettes and related smokers' products, pairs of coaxial plain cigarettes of unit length are moved sideways in the flutes of an assembly conveyor, and a filter rod section or mouthpiece of double unit length is placed between each pair of plain cigarettes. The thus obtained groups of three coaxial articles each are thereupon provided with adhesive-coated uniting bands which are rolled around the mouthpieces and the adjacent end portions of plain cigarettes to convert each group into a filter cigarette of double unit length. Each such cigarette is severed midway between its ends to yield two coaxial filter cigarettes of unit length.

Prior to insertion of filter mouthpieces, the distance between each pair of coaxial plain cigarettes of unit length must be increased so that the width of the resulting gap suffices for reception of a filter mouthpiece of double unit length. In accordance with the presently prevailing practice, plain cigarettes are moved apart by transferring them onto a conveyor system wherein the flute for one cigarette of each pair moves axially or substantially axially and away from the flute for the other cigarette of the same pair. Reference may be had to commonly owned U.S. Pat. No. 3,372,702 granted Mar. 12, 1968 to Bohn et al. which discloses an apparatus wherein the means for increasing the distance between successive pairs of coaxial plain cigarettes of unit length comprises four conical conveyors. Such apparatus are quite satisfactory; however, their space requirements are substantial and the number of component parts is large.

OBJECTS AND SUMMARY OF THE INVENTION

An object of the invention is to provide an apparatus which can be used for changing the distance between successive pairs of coaxial rod-shaped articles and which is simpler and more compact than heretofore known apparatus.

Another object of the invention is to provide an apparatus which can treat the articles gently and which can change the distance between successive pairs of rod-shaped articles with a high degree of accuracy and at the rate at which the articles issue from a high-speed maker.

A further object of the invention is to provide an apparatus which can be rapidly converted for processing of differently dimensioned articles and/or for changing the distance between coaxial articles to any one of a plurality of values.

An additional object of the invention is to provide a novel and improved article transporting conveyor for use in the apparatus of the above outlined character.

An ancillary object of the invention is to provide the apparatus with novel and improved means for moving the articles of each pair with respect to each other.

One feature of the invention resides in the provision of an apparatus for changing the distance between successive pairs of coaxial rod-shaped articles, particularly for increasing the distance between pairs of plain cigarettes or analogous articles which constitute or form part of smokers' products to provide room for insertion of additional articles between the articles of each pair, for example, to provide room for insertion of filter rod sections of double unit length between pairs of coaxial plain cigarettes of unit length. The apparatus comprises means for transporting successive pairs of coaxial articles sideways in a predetermined path (such transporting means may constitute a rotary conveyor which defines an endless path for pairs of plain cigarettes or the like). The transporting means includes a plurality of first and a plurality of second flutes or analogous article receiving means and each first receiving means is aligned with a second receiving means. At least the first receiving means form a plurality of groups (whereby each group consists of one, two or more first receiving means) and the transporting means further includes a segment-shaped or otherwise configurated holder for each group of first receiving means and guide means supporting the holders for reciprocatory movement transversely of the direction of sidewise movement of articles along the path. The apparatus further comprises means for moving the holders with respect to the second receiving means during travel of holders along a predetermined portion of the path. The moving means may include a rod-shaped shifting member for each holder, a follower on each shifting member, and a stationary cam having a face (preferably bounding a portion of an endless cam groove) which is tracked by the follower.

In accordance with a presently preferred embodiment of the invention, the second receiving means form a plurality of second groups each of which is aligned with a group of first receiving means, and the transporting means further includes second holders, one for each group of second receiving means, and guide means supporting the second holders for movement transversely of the direction of sidewise movement of articles. The apparatus further comprises means for moving the second holders with respect to the first receiving means during travel of second holders along a predetermined portion of the path, preferably in such a way that the aligned first mentioned and second holders move in opposite directions. Thus, when a drum-shaped severing conveyor or another suitable feeding device delivers pairs of articles into successive pairs of aligned first and second receiving means ahead of the predetermined portion of the path, the holders move the articles of successive pairs away from each other during transport of articles along the predetermined portion of the path so that the distance between successive pairs of articles increases. The articles are thereupon transferred onto a rotary accepting conveyor or the like and the holders are moved in opposite directions, i.e., nearer to each other so as to place the associated receiving means in an optimum position for reception of fresh articles from the feeding conveyor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 3:
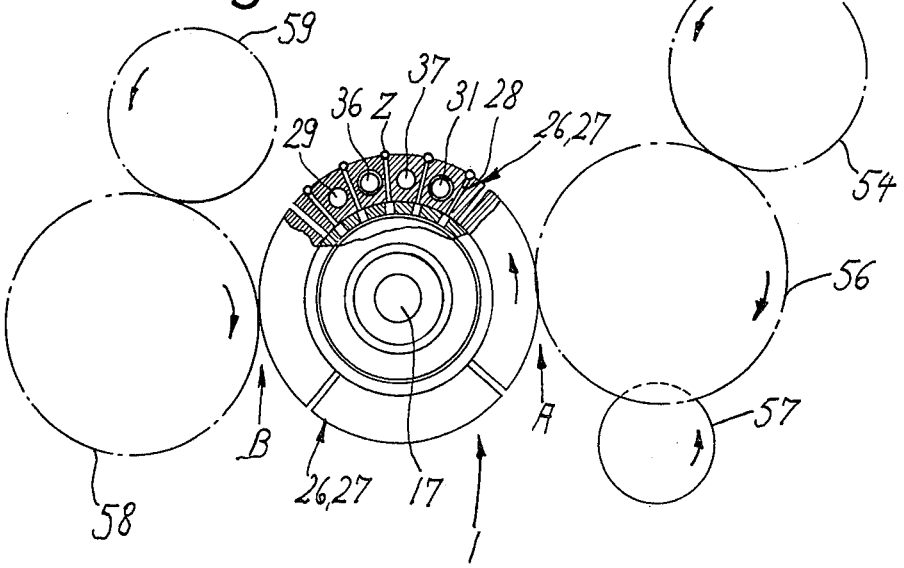
FIG. 3 is a smaller-scale transverse sectional view as seen in the direction of arrows from the line III—III of FIG. 1.

Referring first to FIG. 3, the improved apparatus can be used with advantage in a production line including a cigarette maker and a filter cigarette making machine. In contrast to many presently utilized cigarette makers, the maker a portion of which is shown in FIG. 3 is designed to produce plain cigarettes of double unit length. Such cigarettes are transported sideways in the peripheral flutes of a rotary drum-shaped transfer conveyor 54 of the cigarette maker and into successive flutes of a rotary drum-shaped severing conveyor 56 which cooperates with a rotary disk-shaped knife 57 to sever each plain cigarette of double unit length midway between its ends so that each such cigarette yields a pair of coaxial plain cigarettes Z of unit length.

The severing conveyor 56 delivers pairs of coaxial plain cigarettes Z of unit length (hereinafter called cigarettes for short) to a first transfer station A where the pairs of cigarettes are transferred onto a rotary transporting conveyor 1 of the improved apparatus. The apparatus is designed to increase the distance between the cigarettes Z of each pair so that the width of the gap between each pair of coaxial cigarettes suffices to accommodate a filter rod section or filter mouthpiece of double unit length. Successive pairs of coaxial cigarettes leave the conveyor 1 at a second transfer station B to be admitted into the peripheral flutes of a rotary drum-shaped accepting conveyor 58 constituting the assembly conveyor of a filter cigarette making machine. The latter further comprises an inserting conveyor 59 which has peripheral flutes serving to deliver filter rod sections of double unit length into successive flutes of the assembly conveyor 58 ahead of the transfer station B but invariably in such positions that successive filter rod sections of double unit length which reach the station B are disposed in the gaps between successive pairs of coaxial cigarettes Z. From there on, the resulting groups (each of which consists of two cigarettes Z and a filter mouthpiece of double unit length therebetween) are processed in the customary way. A filter cigarette making machine which can embody or which can be combined with the apparatus of the present invention is manufactured by the assignee of the present application and is known as MAX S.

Figure 1:
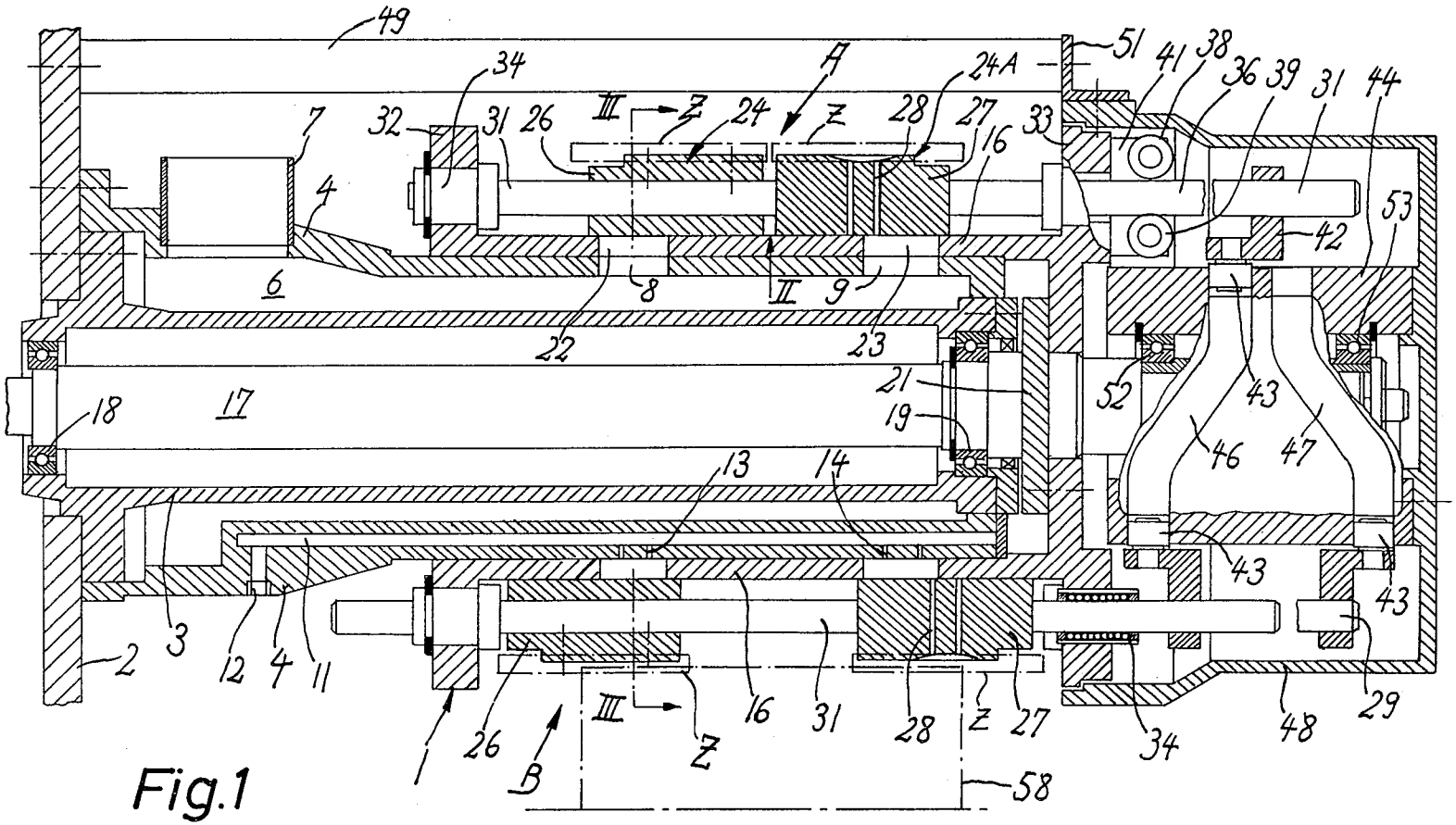
FIG. 1 is an axial sectional view of a rotary transporting conveyor and of certain other parts in an apparatus which embodies the invention.

FIG. 1 shows that the transporting conveyor 1 for pairs of coaxial cigarettes Z comprises a composite drum-shaped body which is supported by a plate-like upright frame member 2 forming part of the frame or housing of the filter cigarette making machine. The drum-shaped body comprises a hollow cylindrical inner core 3 one end portion of which is affixed to the frame member 2 and which is surrounded by a hollow cylindrical outer core 4 also affixed to the member 2. The cores 3 and 4 define a cylindrical suction chamber 6 which is connected to the intake of a suitable suction generating device (e.g., a conventional blower) by a nipple 7 of the outer core 4. The outer core 4 is further formed with circumferentially extending suction ports 8 and 9 serving to attract pairs of cigarettes Z during transport of such cigarettes from the transfer station A to the transfer station B. Still further, the outer core 4 is formed with a channel 11 which can be said to constitute a plenum chamber and is connected to the outlet of a source of compressed air (e.g., to the outlet of the aforementioned blower) by a nipple 12. The cylindrical wall of the core 4 has orifices 13 and 14 which discharge compressed air at the transfer station B to promote the transfer of successive pairs of cigarettes Z into the flutes of the accepting conveyor 58. The orifices 13, 14 can also discharge compressed air into the receiving means for cigarettes Z while such receiving means travel from the station B back to the station A in order to expel fragments of tobacco and/or other foreign matter before the receiving means accept fresh pairs of cigarettes Z from the severing conveyor 56.

The cores 3, 4 constitute a stationary bearing means for a hollow cylindrical rotor 16 which surrounds the core 4 and is driven by a shaft 17 extending through the interior of the inner core 3. The shaft 17 is mounted in two antifriction bearings 18, 19 which are installed in the core 3. The left-hand end portion of the shaft 17 receives torque from the main prime mover of the filter cigarette making machine, and its right-hand end portion is provided with a flange 21 which is bolted, screwed or otherwise affixed to the right-hand end portion of the rotor 16.

The rotor 16 is formed with a first arcuate slot 22 and with a second arcuate slot 23. The slots 22 and 23 communicate with the ports 8, 9 or with the orifices 13, 14 in certain angular positions of the rotor 16.

The aforementioned receiving means for cigarettes Z are elongated flutes 24 and 24A which are parallel with the axis of the conveyor 1. The flutes 24 form a first annulus consisting of a plurality of flutes 24 and the flutes 24A form a second annulus consisting of a plurality of flutes 24A. The flutes 24 form four groups of five flutes 24 each, and the flutes 24A also form four groups of five flutes 24A each. Each group of flutes 24 is machined into the peripheral surface of a discrete segment-shaped holder 26, and each group of flutes 24A is machined into the periphery of a discrete segment-shaped holder 27. Each holder 26 is aligned with a holder 27, as considered in the axial direction of the rotor 16, in such a way that each flute 24 of the holder 26 registers with a flute 24A of the aligned holder 27. It is clear that each group can consist of a single flute 24 or 24A, or of two, three, four, six or more flutes. The holders 26, 27 have radially extending bores 28 which communicate with the flutes 24, 24A and can also communicate with the suction ports 8, 9 and slots 22, 23 or orifices 13, 14 in certain angular positions of the corresponding holders, i.e., in certain portions of the path defined by the conveyor 1 for sidewise movement of pairs of coaxial cigarettes Z.

In accordance with a feature of the invention, the rotor 16 carries guide means which support the segment-shaped holders 26 and 27 for reciprocatory movement in parallelism with the axis of the shaft 17. The arrangement is such that, when a holder 26 moves in a direction to the left, as viewed in FIG. 1, the aligned holder 27 moves in a direction to the right or vice versa. The means for moving the holders 26, 27 relative to their guide means (axially of the rotor 16) comprises elongated shifting rods 29 and 31 which are reciprocable in radially outwardly extending collars 32 and 33 of the rotor 16. In order to reduce friction during axial movement of shifting rods 29 and 31, the collars 32, 33 carry cylindrical antifriction bearings 34 through which the rods 29 and 31 extend. The bearing 34 which is shown in the lower right-hand portion of FIG. 1 has several annuli of spherical rolling elements which are confined in a cylindrical cage secured to the collar 33 and which are in point contact with the periphery of the shifting rod 31.

The guide means for the holders 26 and 27 comprise elongated tie rods 36 and 37. FIG. 3 shows that the tie rods 36, 37 for each pair of aligned holders 26, 27 are disposed between the respective shifting rods 29, 31. The tie rods 36 and 37 extend through the collar 33 of the rotor 16. The collar 33 supports carriers 41, one for each of the tie rods 36, 37, and each carrier 41 supports two pairs of rollers 38, 39 which engage the periphery of the respective tie rod in a manner best shown in the upper right-hand portion of FIG. 1. The rollers 38 are disposed outwardly and the rollers 39 are disposed inwardly of the respective tie rods, as considered in the radial direction of the rotor 16.

Figure 2:
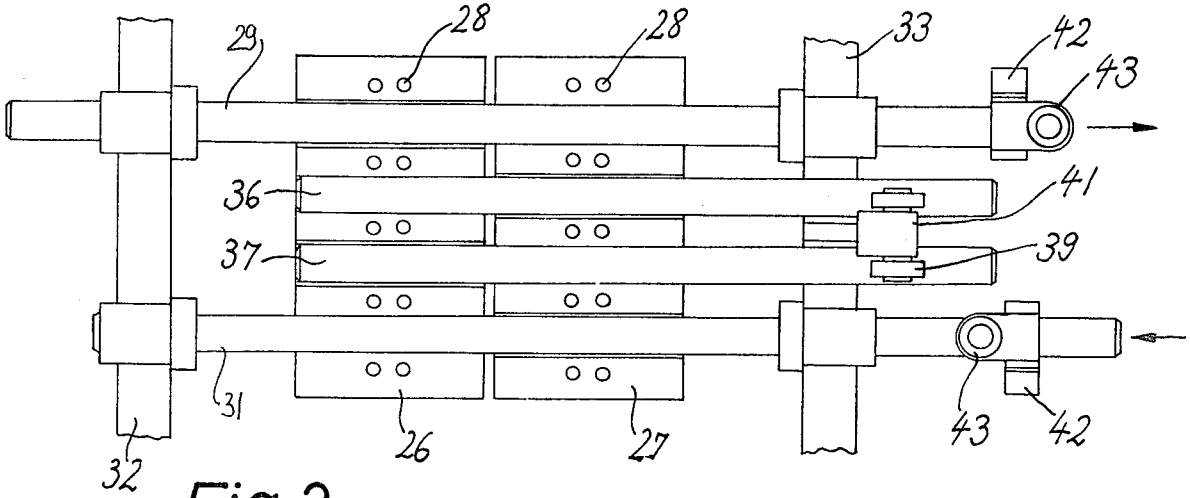
FIG. 2 is a diagrammatic view of the inner sides of two alinged holders, substantially as seen in the direction of arrow II in FIG. 1.

FIG. 2 shows that the rods 31, 36 are rigid with the respective holder 26 and the rods 29, 37 are rigid with the respective holder 27. Thus, when the shifting rod 29 of FIG. 2 is moved in a direction to the right, as viewed in FIG. 2, the holder 27 of FIG. 2 moves in the same direction. At the same time, the shifting rod 31 of FIG. 2 moves the holder 26 in a direction to the left, i.e., away from the aligned holder 27. This results in an increase of the width of the gap between the cigarettes Z which are received in the flutes 24 of the holder 26 and cigarettes Z which are received in the flutes 24A of the aligned holder 17. The holder 26 of FIG. 2 is freely slidable on the rods 29, 37 and the holder 27 of FIG. 2 is freely slidable on the rods 31, 36.

The moving means for the holders 26, 27 further comprises brackets 42 which are attached to or made integral with the right-hand portions of the shifting rods 29, 31, as viewed in FIG. 1, and carry roller followers 43 extending into the groove 46 or 47 of a stationary cylinder cam 44. The roller followers 43 which are associated with the shifting rods 31 for the holders 26 extend into the groove 46, and the roller followers 42 which are associated with the shifting rods 29 for the holders 27 extend into the groove 47. The grooves 46 and 47 have mirror symmetrical portions which cause the holders 26, 27 to move toward or away from each other during certain stages of movement of holders about the axis of the shaft 17 when the latter drives the rotor 16. The cam 44 is supported by and held against rotation by a cover or cap 48 which is provided with a bracket 51 for one end of a connecting rod 49 serving to secure the cam 44 to the frame member 2. The cam 44 contains two additional antifriction bearings 52, 53 for the drive shaft 17.

The roller followers 43 of those holders 26, 27 which approach and travel past the transfer station A or B are received in parallel portions of cam grooves 46, 47, i.e., such portions of the cam grooves extend circumferentially of the cam 44 so that the distance between the holders 26, 27 which travel past the station A is constant and the holders 26, 27 are immediately adjacent to each other. The distance between the holders 26, 27 which travel past the transfer station B is also constant; however, the holders 26, 27 are then located at a maximum distance from each other or at a distance which suffices to insure that the gaps between successive pairs of coaxial cigarettes Z are wide enough to receive filter rod sections of double unit length. As a rule, the cigarettes Z which enter a pair of aligned flutes 24, 24A at the transfer station A actually abut against or are immediately adjacent to each other.

As the holders 26, 27 whose flutes 24, 24A have received pairs of coaxial cigarettes Z at the transfer station A advance beyond the station A and move on toward the transfer station B, the roller followers 43 for such holders enter the divergent portions of cam grooves 46, 47 so that the holders 26, 27 move away from each other and increase the distance between the cigarettes Z of the corresponding pairs. The cigarettes Z are held against any movement relative to their flutes 24, 24A because such flutes communicate with the suction chamber 6 via suction ports 8, 9, slots 22, 23 and bores 28 of the respective holders 26, 27.

When the holders 26, 27 reach the transfer station B, the corresponding roller followers 43 enter two spaced-apart parallel portions of the cam grooves 46, 47 so that the width of the gaps between the pairs of cigarettes Z on such holders reamins unchanged. The bores 28 then receive compressed air from the plenum chamber 11 via orifices 13 and 14 so that the jets of compressed air cause or promote the transfer of successive pairs of cigarettes Z into successive flutes of the accepting conveyor 58.

The cam 44 thereupon causes the holders 26, 27 to move toward each other and to assume positions at a minimum distance from each other not later than during travel past the transfer station A where the respective pairs of flutes 24, 24A receive fresh pairs of coaxial cigarettes Z. As mentioned above, the bores 28 can communicate with the plenum chamber 11 while the respective holders 26, 27 travel from the transfer station B back to the transfer station A in order to insure that compressed air will expel particles of tobacco and/or other foreign matter before the flutes reach the station A.

It is also within the purview of the invention to replace the holders 26 or 27 with a ring which is fixed to the rotor 16 and whose periphery is provided with the flutes 24 or 24A. The holders 27 or 26 are then caused to move through greater distances to insure that the distance between the cigarettes Z of each pair increases sufficiently to provide room for insertion of a filter mouthpiece of double unit length. The construction which is shown in the drawing is preferred at this time because each of the holders 26, 27 must be shifted through a relatively short distance which, in turn, reduces the likelihood of uncontrolled axial movement of cigarettes Z in their flutes 24 or 24A.

The tie rods 36 and 37 move axially during shifting of the holders 26, 27 because the tie rods 36 are affixed to the holders 26 and the tie rods 37 are affixed to the holders 27.

An important advantage of the improved apparatus is that a single conveyor (1) suffices to transport pairs of cigarettes during movement of cigarettes of each pair axially with respect to each other. Moreover, the ends of cigarettes in the flutes 24 and 24A need not be engaged by mechanical means, such as conventional cams which are used for such purposes in many presently known machines for the production and/or processing of rod-shaped articles which constitute or form part of smokers' products. Direct engagement between stationary cams and rapidly moving cigarettes is undesirable because the cams are likely to deform or otherwise damage or even destroy the wrappers. Also, the cams can cause escape of tobacco particles at the ends of cigarettes.

If the apparatus is to transport and manipulate rod-shaped articles of different length, the illustrated rotor 16 and cam 44 are replaced with differently dimensioned parts. Such replacement of the rotor 16 and cam 44 can be effected from the right-hand side of the apparatus, as viewed in FIG. 1, without necessitating even partial dismantling of other components.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for changing the distance between successive pairs of coaxial rod-shaped articles, particularly for increasing the distance between pairs of articles which constitute or form part of smokers' products to provide room for insertion of additional articles between the articles of each pair, comprising means for transporting successive pairs of coaxial articles sideways in a predetermined direction along an endless path, said transporting means comprising a rotary conveyor including a plurality of first and a plurality of second article receiving means, each second receiving means being aligned with a first receiving means and at least said first receiving means forming a plurality of groups, said transporting means further including a mobile holder for each of said groups; and means for moving said holders substantially transversely of said direction during travel of said holders along a predetermined portion of said path.

2. Apparatus as defined in claim 1, wherein said second receiving means form a plurality of second groups each of which is aligned with one of said first mentioned groups, said transporting means further including a second mobile holder for each of said second groups and further comprising means for moving said second holders substantially transversely of said direction during travel of said second holders along said portion of said path.

3. Apparatus as defined in claim 2, wherein said moving means include means for moving successive first mentioned and the aligned second holders in opposite directions.

4. Apparatus as defined in claim 3, wherein said moving means include cam means and follower means provided on said holders and tracking said cam means.

5. Apparatus as defined in claim 4, wherein said cam means comprises a first cam for the follower means of said first mentioned holders and a second cam for the follower means of said second holders.

6. Apparatus as defined in claim 2, wherein said moving means include a plurality of shifting rods, one for each of said holders, and means for moving said holders by way of the respective rods.

7. Apparatus as defined in claim 1, further comprising guide means supporting said holders for reciprocatory movement substantially transversely of said direction.

8. Apparatus as defined in claim 7, wherein said guide means comprises an elongated tie rod for each of said holders, said tie rods being supported by said transporting means and sharing the movement of said receiving means along said path.

9. Apparatus as defined in claim 1, wherein said moving means comprises a shifting member for each of said holders, a follower on each of said shifting members and a stationary cam having a face which is tracked by said followers.

10. Apparatus as defined in claim 9, wherein said cam has an endless groove for said followers and said face bounds a portion of said groove.

11. Apparatus as defined in claim 1, further comprising means for feeding pairs of coaxial articles to successive registering first and second receiving means at a first station located ahead of said portion of said path and means for accepting pairs of coaxial articles from successive registering first and second receiving means at a second station located behind said portion of said path, as considered in said direction.

12. Apparatus for changing the distance between successive pairs of coaxial rod-shaped articles, particularly for increasing the distance between pairs of articles which constitute or form part of smokers' products to provide room for insertion of additional articles between the articles of each pair, comprising means for transporting successive pairs of coaxial articles sideways in a predetermined direction along a predetermined path, including a plurality of first and a plurality of second article receiving means, each second receiving means being aligned with a first receiving means and at least said first receiving means forming a plurality of groups, said transporting means further including a mobile holder for each of said groups, stationary bearing means and a rotor mounted on said bearing means and supporting said holders and said second receiving means; and means for moving said holders substantially transversely of said direction during travel of said holders along a predetermined portion of said path.

13. Apparatus for changing the distance between successive pairs of coaxial rod-shaped articles, particularly for increasing the distance between pairs of articles which constitute or form part of smokers' products to provide room for insertion of additional articles between the articles of each pair, comprising a rotary conveyor for transporting successive pairs of coaxial articles sideways in a predetermined direction along a predetermined path, including a plurality of first and a plurality of second article receiving means, each second receiving means being aligned with a first receiving means and at least said first receiving means forming a plurality of groups, said conveyor further including a mobile holder for each of said groups and a rotor supporting said holders and including at least one radially extending collar; and means for moving said holders substantially transversely of said direction during travel of said holders along a predetermined portion of said path, said moving means including portions supported by said collar.

14. Apparatus for changing the distance between successive pairs of coaxial rod-shaped articles, particularly for increasing the distance between pairs of articles which constitute or form part of smokers' products to provide room for insertion of additional articles between the articles of each pair, comprising a rotary conveyor for transporting successive pairs of coaxial articles sideways in a predetermined direction along a predetermined path, including a plurality of first and a plurality of second article receiving means, each second receiving means being aligned with a first receiving means and at least said first receiving means forming a plurality of groups, said conveyor further including a mobile holder for each of said groups and a rotor supporting said holder and including at least one radially extending collar; guide means supporting said holders for reciprocatory movement substantially transversely of said direction, said guide means being supported by said collar and including an elongated tie rod for each of said holders and roller means mounted on said collar and engaging said tie rods; and means for moving said holders substantially transversely of said direction during travel of said holders along a predetermined portion of said path.

15. Apparatus for changing the distance between successive pairs of coaxial rod-shaped articles, particularly for increasing the distance between pairs of articles which constitute or form part of smokers' products to provide room for insertion of additional articles between the articles of each pair, comprising means for transporting successive pairs of coaxial articles sideways in a predetermined direction along a predetermined path, including a plurality of first and a plurality of second article receiving means, each second receiving means being aligned with a first receiving means and at least said first receiving means forming a plurality of groups, said transporting means further including a mobile holder for each of said groups; means for moving said holders substantially transversely of said direction during travel of said holders along a predetermined portion of said path; and means for holding the articles in said receiving means against movement relative to the respective receiving means during transport of articles along said predetermined portion of said path.

* * * * *